US009037031B2

(12) United States Patent
Masuda

(10) Patent No.: US 9,037,031 B2
(45) Date of Patent: May 19, 2015

(54) IMAGE FORMING APPARATUS INCLUDING CONTROL SUBSTRATE CONNECTED TO ELECTRICAL COMPONENT THROUGH CABLE

(75) Inventor: Sadahiro Masuda, Shizuoka-ken (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 493 days.

(21) Appl. No.: 13/444,745

(22) Filed: Apr. 11, 2012

(65) Prior Publication Data

US 2012/0263490 A1 Oct. 18, 2012

Related U.S. Application Data

(60) Provisional application No. 61/475,626, filed on Apr. 14, 2011.

(51) Int. Cl.
*G03G 15/00* (2006.01)
*G03G 21/16* (2006.01)

(52) U.S. Cl.
CPC ..... *G03G 15/80* (2013.01); *G03G 21/1633* (2013.01); *G03G 2221/1684* (2013.01)

(58) Field of Classification Search
CPC ..... G03G 21/1633
USPC ..... 399/90
See application file for complete search history.

(56) References Cited

U.S. PATENT DOCUMENTS

| | | | | |
|---|---|---|---|---|
| 3,675,084 | A * | 7/1972 | Jammaud | 361/724 |
| 5,235,494 | A * | 8/1993 | Chang et al. | 361/736 |
| 5,881,340 | A * | 3/1999 | Stickney et al. | 399/110 |
| 5,918,089 | A * | 6/1999 | Malinich et al. | 399/90 |
| 6,366,747 | B1 * | 4/2002 | Roller | 399/110 |
| 8,249,484 | B2 | 8/2012 | Yamaguchi | |
| 2007/0008696 | A1 * | 1/2007 | Masuda | 361/685 |
| 2009/0035008 | A1 * | 2/2009 | Inukai et al. | 399/88 |
| 2010/0226683 | A1 * | 9/2010 | Yamaguchi | 399/110 |
| 2013/0164020 | A1 * | 6/2013 | Matsuno | 399/90 |

FOREIGN PATENT DOCUMENTS

| | | | |
|---|---|---|---|
| JP | 2008-003354 | | 1/2008 |
| JP | 2010210834 | A | 9/2010 |
| JP | 2012226350 | A * | 11/2012 |

OTHER PUBLICATIONS

Office Action dated Jan. 6, 2015, filed in Japanese counterpart Application No. 2012-090675, 10 pages (with English translation).

* cited by examiner

*Primary Examiner* — David Gray
*Assistant Examiner* — Geoffrey Evans
(74) *Attorney, Agent, or Firm* — Patterson & Sheridan LLP

(57) ABSTRACT

According to the embodiment, a case supporting part supports a substrate case on an apparatus housing in a manner that allows the substrate case to move between a first position and a second position. The first position is contained in a first range extending in a predetermined direction parallel to the side surface of the apparatus housing where a maintenance target is provided closer thereto and covering also the position of at least part of the maintenance target. The second position is contained in a range extending in the predetermined direction and covering the position of the maintenance target with the range being narrower than the first range. A control substrate is arranged such that, when the substrate case is at the first position, a plurality of connections are placed at positions corresponding to the positions of respective electrical components to which the control substrate is to be connected.

6 Claims, 10 Drawing Sheets

IMAGE FORMING APPARATUS INCLUDING CONTROL SUBSTRATE CONNECTED TO ELECTRICAL COMPONENT THROUGH CABLE

CROSS-REFERENCE TO RELATED APPLICATION

This application is based upon and claims the benefit of priority from U.S. provisional application 61/475,626, filed on Apr. 14, 2011; the entire contents of which are incorporated herein by reference.

FIELD

Embodiments described herein relate generally to a technique of routing a cable in an image forming apparatus.

BACKGROUND

An image forming apparatus includes a substrate for controlling a mechanical member such as a motor and a solenoid, a substrate for controlling the system of the entire apparatus, and others. These substrates are generally fixed to the back surface of an apparatus housing with screws or the like in consideration of easiness of attachment and detachment during maintenance, easiness of addition of an optional substrate, and easiness of cooling with external air.

Meanwhile, a maintenance target such as a fan and a motor targeted for maintenance is provided to the back surface of the apparatus housing to which a substrate is fixed. The substrate is fixed to the back surface of the apparatus housing so as to cover the maintenance target. Accordingly, in a conventional image forming apparatus, the substrate should be removed from the apparatus housing for maintenance of the maintenance target, resulting in a problem of difficulty in making access to the maintenance target.

In an image forming apparatus to cope with this problem, a substrate case is pivotably provided to the back surface of the apparatus housing, and a substrate is fixed to the substrate case. In this apparatus, a supporting part is provided at a right or left edge portion of the substrate case, and the supporting part supports the substrate case in a manner that allows the substrate case to pivot relative to the apparatus housing. When a maintenance target provided on the back surface of the apparatus housing is accessed, the substrate case is caused to pivot on the supporting part in a direction in which the substrate case is separated away from the apparatus housing, thereby allowing access to the maintenance target without the need of removing the substrate case from the apparatus housing.

However, the structure of this apparatus is generally such that cables connecting electrical components housed in the apparatus housing and the substrate pass through positions near the supporting part. In this case, noise is generated easily in a signal as a result of proximity of the respective cables, resulting in a problem in that the countermeasure for noise entails costs.

DETAILED DESCRIPTION

According to an embodiment, an image forming apparatus generally includes a maintenance target, an apparatus housing, a substrate case, a case supporting part, and a control substrate. The maintenance target is a target of maintenance. The apparatus housing houses the maintenance target at a position nearer a side surface of the apparatus housing than the center of the apparatus. The substrate case holds the control substrate that is electrically connected at a plurality of connections to a plurality of electrical components provided in the apparatus housing. The case supporting part supports the substrate case on the apparatus housing in a manner that allows the substrate case to move between a first position and a second position. The first position is contained in a first range extending in a predetermined direction parallel to the side surface of the apparatus housing where the maintenance target is provided closer thereto and covering also the position of at least part of the maintenance target. The second position is contained in a range extending in the predetermined direction and covering the position of the maintenance target with the range being narrower than the first range. The control substrate is arranged such that, when the substrate case is at the first position, a plurality of connections are placed at positions corresponding to the positions of respective electrical components to which the control substrate is to be connected.

According to an embodiment, an image forming apparatus generally includes a substrate case, a plurality of cables, and a regulating part. The substrate case holds a control substrate that is electrically connected at a plurality of connections to a pluralityof electrical components provided in an apparatus housing. The plurality of cables connect the electrical components and the connections. The regulating part is attached to the apparatus housing. The regulating part separates parts of the cables from each other, and regulates movement of one of the cables toward a different one of the cables.

Embodiments are described below with reference to the drawings.

First Embodiment

Figure 1:
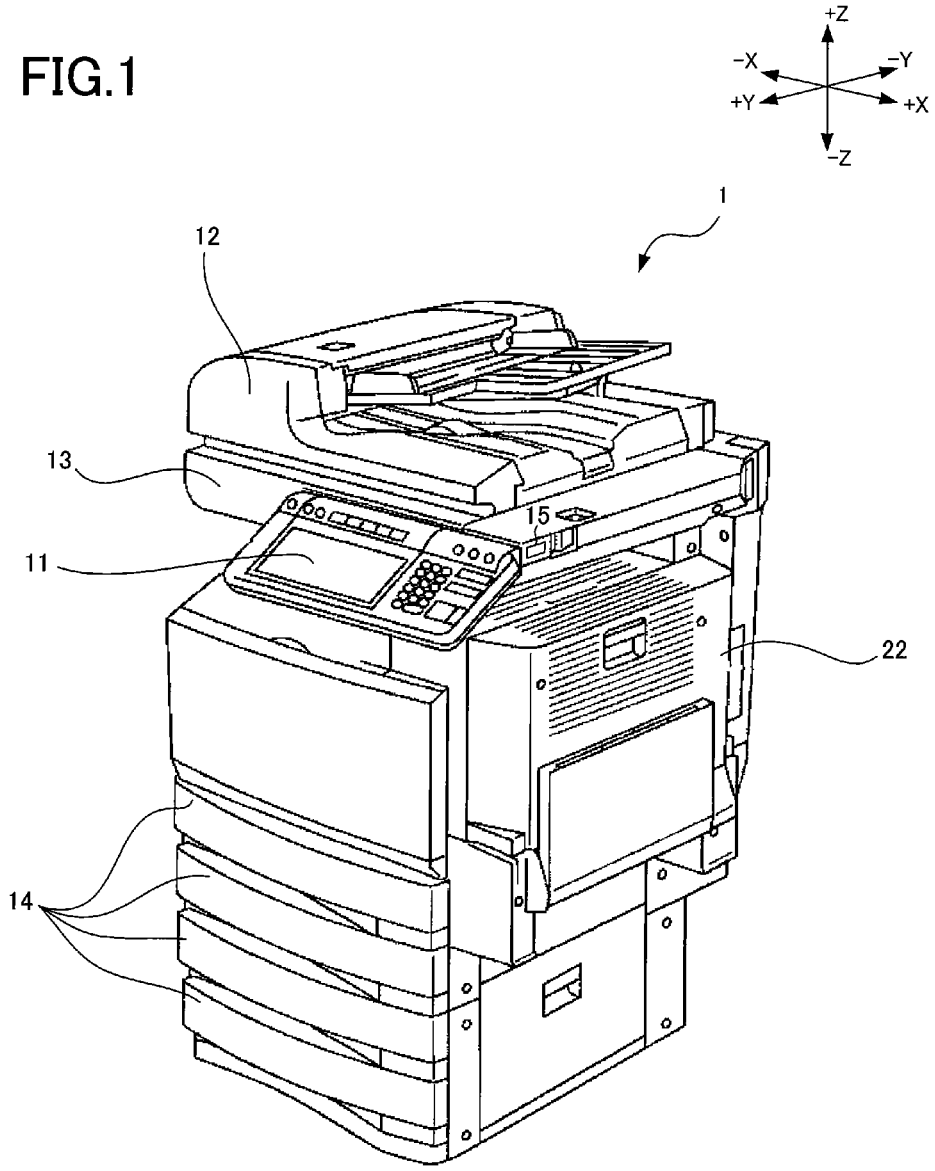
FIG. 1 is a perspective view of an image forming apparatus of a first embodiment.

FIG. 1 is a perspective view of an image forming apparatus 1. In FIG. 1, upward and downward directions are referred to as +Z and −Z directions respectively, rightward and leftward directions are referred to as +X and −X directions respectively, and forward and backward directions are referred to as +Y and −Y directions respectively.

The image forming apparatus 1 is an MFP (multi-function peripheral). In response to operational input by a user accepted on a touch panel 11, the image forming apparatus 1 causes an image reading section 13 to read a sheet placed on an ADF 12, and generates a print job containing image data, a command such as the number of pages to be printed, and the like. The image forming apparatus 1 feeds a sheet in a sheet feeding cassette 14 to an image forming section 22, and causes the image forming section 22 to form an image on the sheet on the basis of the print job. A connector 15 for a USB (universal serial bus) is provided on the right side surface of the image forming apparatus 1 (corresponding to the left side surface if the image forming apparatus 1 is viewed from the back surface thereof). The image forming apparatus 1 is capable of transmitting read image data to a USB memory connected to the connector 15.

Figure 2:
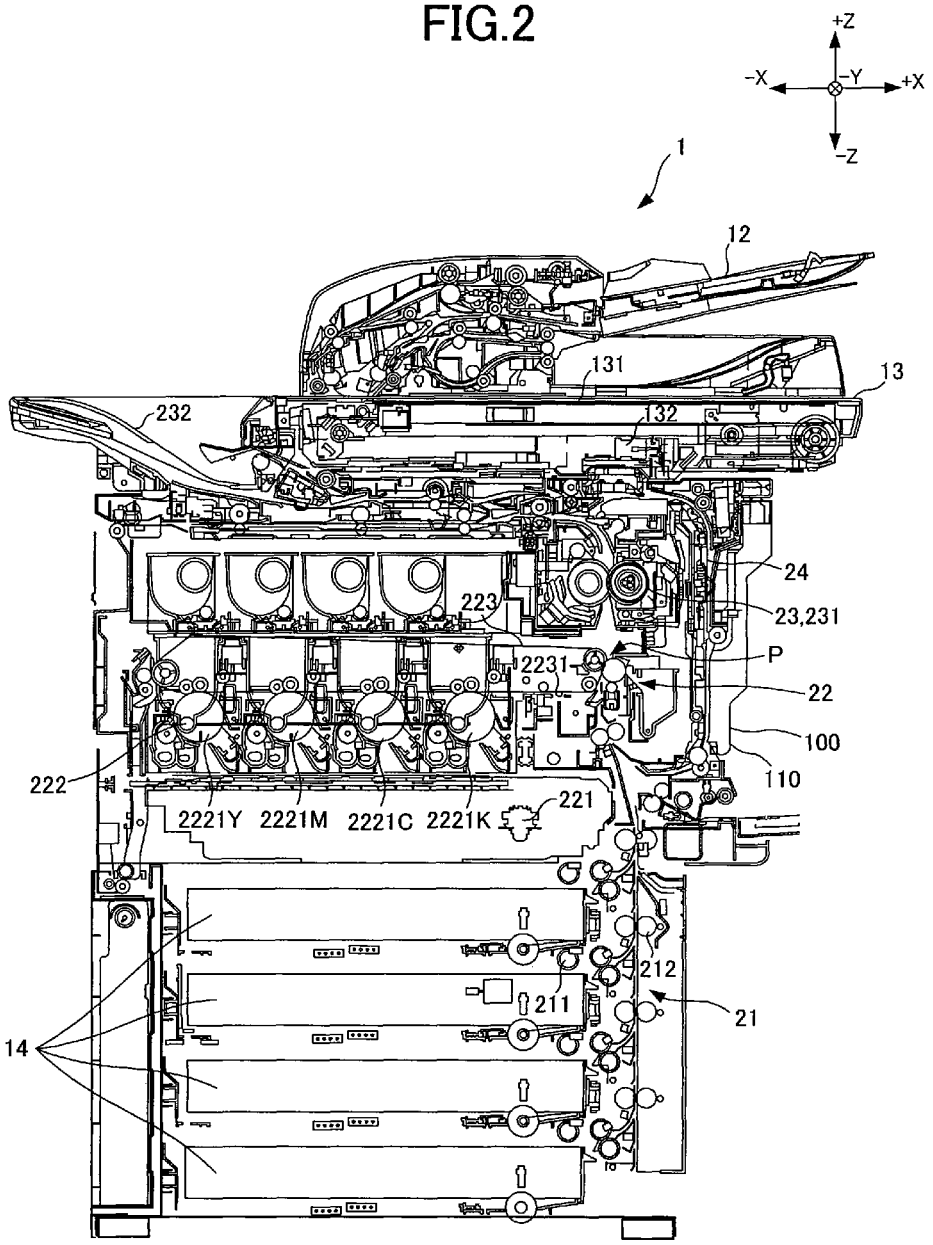
FIG. 2 is a diagram showing the internal structure of the image forming apparatus.

FIG. 2 is a diagram showing the internal structure of the image forming apparatus 1.

The image reading section 13 causes a CCD (charge-coupled device) 132 to read an image on a sheet placed on a document table 131 or the ADF 12. The image forming apparatus 1 includes components 11 to 15 and 22 of FIG. 1, and additionally, includes a sheet feeding section 21, a fixing and discharging section 23, and an ADU (automatic duplex unit) 24. The sheet feeding section 21 takes a sheet out of the sheet feeding cassette 14 with a pickup roller 211 and the like, and feeds the sheet to the image forming section 22 with a feeding roller 212. In the image forming section 22, a laser unit 221 forms electrostatic latent images with laser on photosensitive members 2221Y, 2221M, 2221C and 2221K of developing units 222 for respective colors. The developing units 222 develop the electrostatic latent images on the photosensitive members 2221Y, 2221M, 2221C and 2221K to form toner images of the respective colors on the photosensitive members 2221Y, 2221M, 2221C and 2221K. The photosensitive members 2221Y, 2221M, 2221C and 2221K place the toner images of the respective colors on a transfer belt 2231 of a transfer unit 223, and transfers the toner images on the transfer belt 2231, thereby forming a single color toner image. The transfer belt 2231 transfers the toner image onto a sheet at a transfer position P. The fixing and discharging section 23 heats the sheet under pressure at a fixing member 231 to fix the image on the sheet, and then discharges the sheet onto a discharge tray 232. The ADU 24 turns the sheet inside out with one side on which the image has been formed, and then feeds the sheet to the transfer position P.

The components 11 to 15 and 21 to 24 are assembled on a frame to become one unit, thereby forming an apparatus body 100. The frame, sheet metal and the like being the outer surface of the apparatus body 100 forms an apparatus housing 110. The apparatus housing 110 houses a maintenance target such as a motor described later such that the maintenance target is placed at a position closer to a side surface (back surface) of the apparatus 1 than the center of the apparatus 1.

Figure 3:
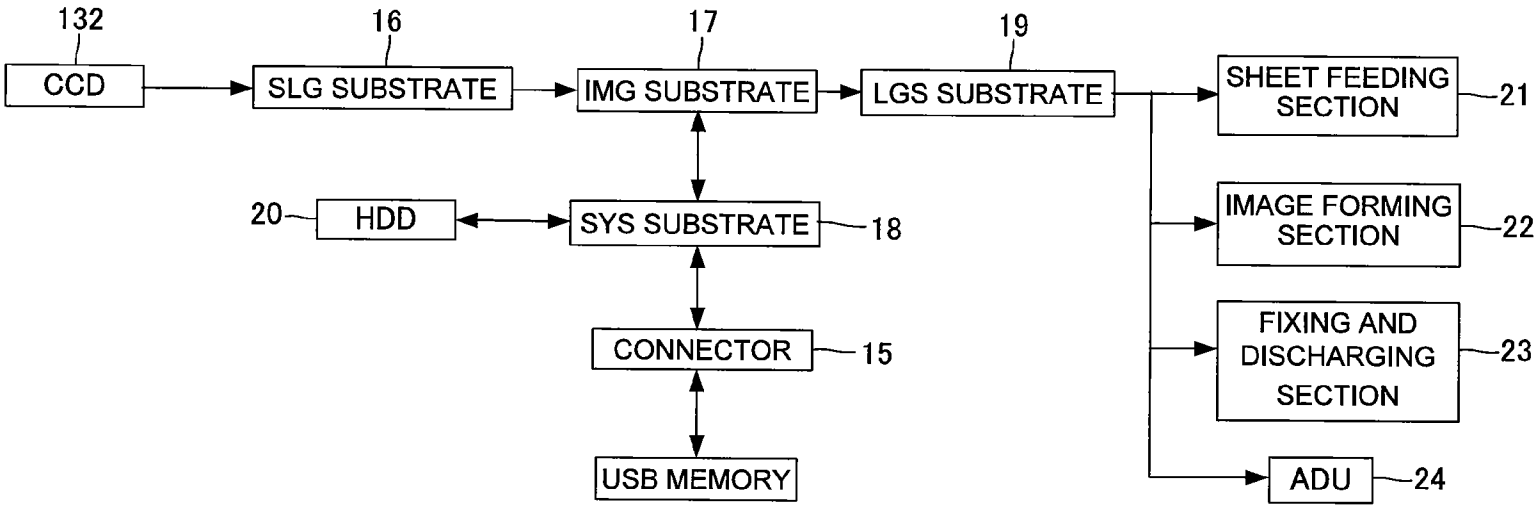
FIG. 3 is a block diagram showing the system of the image forming apparatus.

FIG. 3 is a block diagram showing the system of the image forming apparatus 1.

The image forming apparatus 1 includes an SLG substrate (soda lime glass substrate) 16, an IMG substrate (image substrate) 17 (first substrate), an SYS substrate (system substrate) 18 (first substrate), an LGS substrate (logical substrate) 19 (second substrate), and a HDD (hard disk drive) 20. Each of the substrates 16 to 19 (control substrates) includes an ASIC (application specific integrated circuit), a memory such as a ROM (read only memory) and a RAM (random access memory), and a CPU (central processing unit) as needed.

The SLG substrate 16 controls the driving of the CCD 132. Also, the SLG substrate 16 performs process on image data output from the CCD 132 such as shading correction and 3-line correction.

The IMG substrate 17 performs process on image data output from the SLG substrate 16 such as color conversion, inking, gamma correction, compression, and decompression.

The SYS substrate 18 performs process on image data output from the IMG substrate 17 such as black overprint, chroma control, brightness control, and contrast control. The SYS substrate 18 stores image data into the HDD 20. The SYS substrate 18 has the function of a USB host, and is capable of transmitting and receiving image data to and from a USB memory connected to the connector 15. The SYS substrate 18 is responsible for control of each of the components of the image forming apparatus 1 including the sheet feeding section 21, the image forming section 22, the fixing and discharging section 23, and the ADU 24.

The LGS substrate 19 performs process on image data output from the SYS substrate 18 such as smoothing and image area process. The LGS substrate 19 controls the laser unit 221 of the image forming section 22 on the basis of image data. The LGS substrate 19 controls each of the components of the image forming apparatus 1 on the basis of a control signal output from the SYS substrate 18. More specifically, the LGS substrate 19 controls a movable member such as a motor, a clutch and a solenoid, and a high-voltage transformer provided for each component of the image forming apparatus 1.

Figure 4:
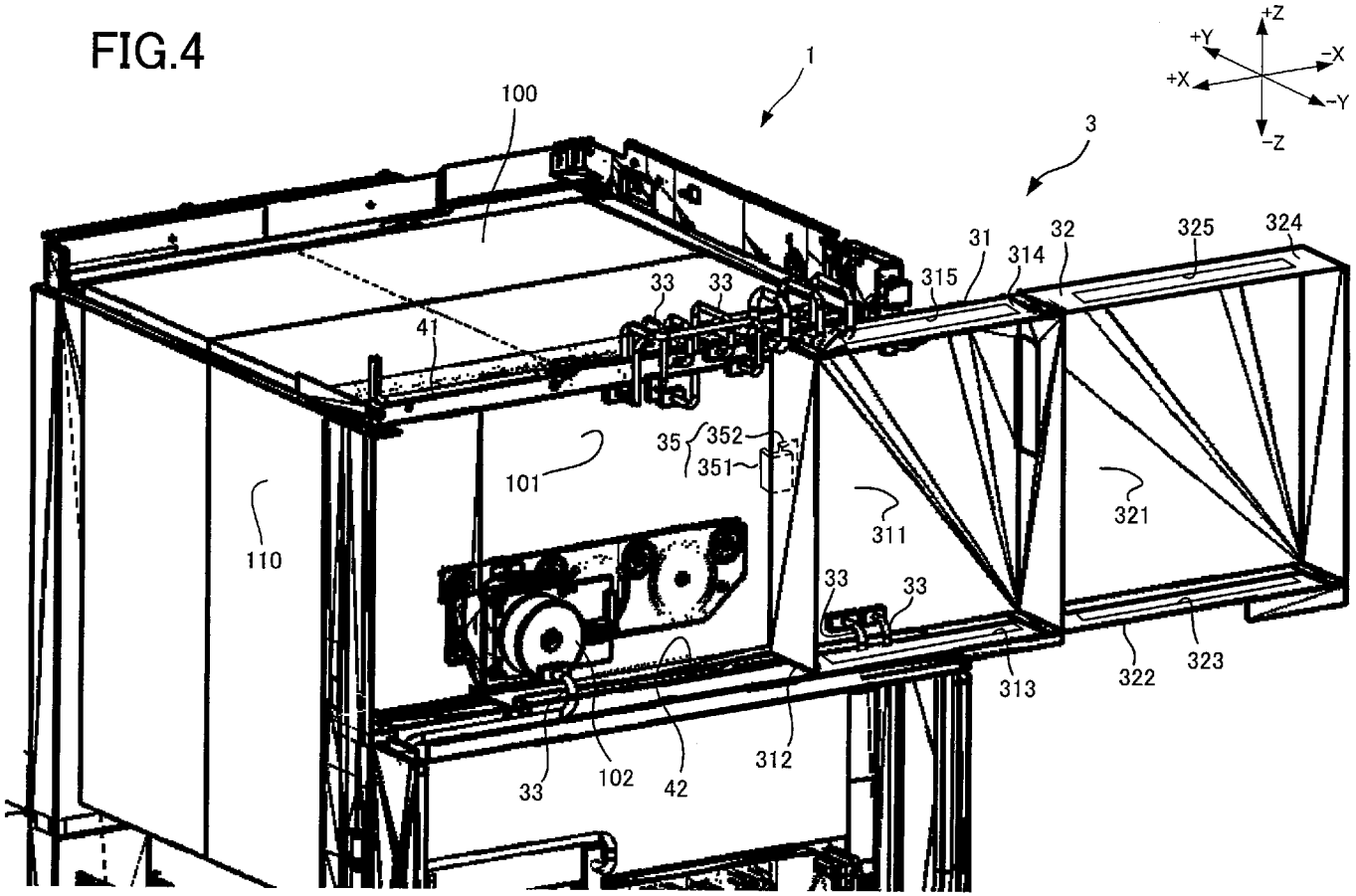
FIG. 4 is a perspective view of the image forming apparatus as viewed from the back surface thereof while an image reading section is removed from the image forming apparatus.

FIG. 4 is a perspective view of the apparatus body 100 as viewed from a back surface 101 while the image reading section 13 is removed from the apparatus body 100.

A motor 102 supplying driving force to members in the apparatus housing 110 is exposed at the back surface 101 of the apparatus housing 110. In the image forming apparatus 1, each of the sheet feeding section 21, the image forming section 22, the fixing and discharging section 23, and the ADU 24 is given one, or a plurality of motors supplying driving force to a corresponding section, and one, or a plurality of fans for cooling the corresponding section. The motor 102 is provided for one of the sections 21 to 24, and is a target of maintenance. In the below, the motor 102 is referred to as a maintenance target 102. Motors not shown in the drawings except the motor 102 and fans not shown in the drawings in the drawings are provided on the back surface 101 of the apparatus body 100. These components are targets of maintenance, and are referred to as maintenance targets. Electrical components are provided inside the apparatus housing 110. An opening is formed on the back surface 101 of the apparatus housing 110 through which the electrical components are accessed, and a cover and the like for closing the opening is also referred to as a maintenance target.

The substrates 17 to 19 and the HDD 20 are attached to the back surface 101 of the apparatus housing 110 so as to cover the maintenance target 102. A structure 3 for attaching the substrates 17 to 19 and the HDD 20 is described next.

The attaching structure 3 includes substrate cases 31 and 32, guide parts 41 and 42 (case supporting part), cables 33, a regulating part 34 described later, and a stopper 35.

The substrate cases 31 and 32 hold the control substrates 17 to 19 electrically connected at a plurality of connections to a plurality of electrical components such as motor 102 placed in the apparatus housing 110. The substrate cases 31 and 32 are guided by the guide parts 41 and 42, thereby allowing the substrate cases 31 and 32 to make sliding movements to the right and left along the back surface 101 of the apparatus housing 110. The substrate cases 31 and 32 are each in the form of a box with one side opened, and planer substrate holding portions 311 and 321 are formed at bottom parts in a housing space. The substrate cases 31 and 32 are formed by processing sheet metal. The substrate cases 31 and 32 are connected while being juxtaposed side by side, and are formed as an integrated part. The substrate cases 31 and 32 are arranged such that the substrate holding portions 311 and 321 are vertically placed.

The substrate holding portion 311 holds the IMG substrate 17, the SYS substrate 18, and the HDD 20 in positions parallel to the substrate holding portion 311. The substrate holding portion 311 may hold some of or all of the IMG substrate 17, the SYS substrate 18, and the HDD 20 in positions one above the other. The substrate holding portion 321 holds the LGS substrate 19 in positions parallel to the substrate holding portion 321. Planar bottom surface portions 312 and 322 are formed at lower end portions of the substrate cases 31 and 32. Opening portions 313 and 323 extending in the rightward and leftward directions (+X and −X directions) are formed at the bottom surface portions 312 and 322, respectively. Planer top surface portions 314 and 324 are formed at upper end portions of the substrate cases 31 and 32, respectively. Opening portions 315 and 325 extending in the rightward and leftward directions (+X and −X directions) are formed at the top surface portions 314 and 324, respectively.

A total of the lengths of the substrate cases 31 and 32 in the rightward and leftward directions is substantially the same as the length of the back surface 101 of the apparatus housing 110 in the rightward and leftward directions.

The stopper 35 includes a projection 351 and a stopper's projection 352. The projection 351 is provided on a surface of the substrate case 31 facing the apparatus housing 110. The stopper's projection 352 is provided on the back surface 101 of the apparatus housing 110. If the substrate cases 31 and 32 move rightward by a predetermined amount or greater than the predetermined amount, the projection 351 comes into abutting contact with the stopper's projection 352, thereby preventing the substrate cases 31 and 32 from falling off the guide parts 41 and 42.

Figure 5:
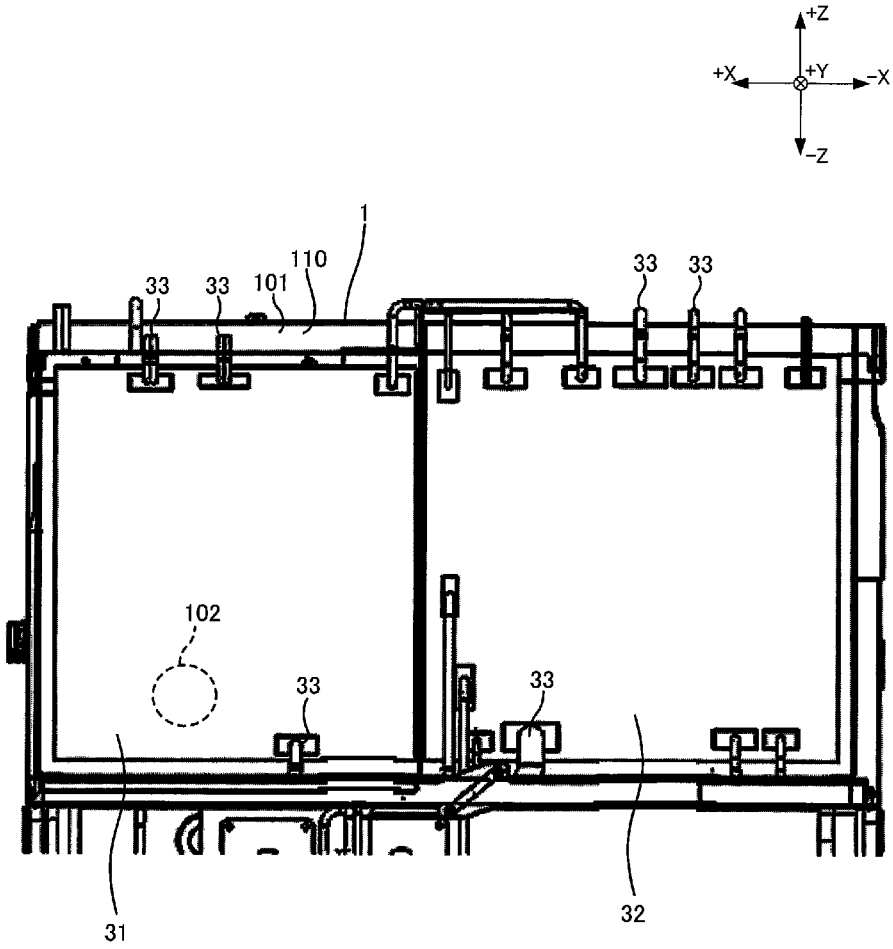
FIG. 5 is a diagram showing the state where substrate cases are fixed.

FIG. 5 is a diagram showing the state where the substrate cases 31 and 32 are fixed to the apparatus housing 110.

In a normal condition where the apparatus 1 is in operation, the substrate cases 31 and 32 are aligned side by side and fixed with a screw 36 (FIG. 7) to the apparatus housing 110 to cover the maintenance target 102.

The substrate case 31 is fixed to a place nearer the left side (left side of FIG. 5) than the substrate case 32 when the apparatus housing 110 is viewed from the back surface 101. The substrate case 31 covers the maintenance target 102 exposed at the back surface 101 of the apparatus housing 110. The connector 15 for connection to a USB memory is disposed on the left side surface of the apparatus housing 110 as viewed in FIG. 5. The substrate case 31 holds the SYS substrate 18 having the function of a USB host. Accordingly, the substrate case 31 is fixed to the left side of FIG. 5 that is nearer the connector 15 than the substrate case 32 holding the LGS substrate 19.

Connectors (connections) are provided at upper parts of the substrates 17 to 19 held by the substrate cases 31 and 32. While the substrate cases 31 and 32 are fixed to the apparatus housing 110, parts of the cables 33 pass through the opening portions 315 and 325 in the top surface portions 314 and 324 of the substrate cases 31 and 32, and are inserted into the connectors at the upper parts of the substrates 17 to 19.

Connectors are also provided at lower parts of the substrates 17 to 19. Parts of the cables 33 pass through the opening portions 313 and 323 in the bottom surface portions 312 and 322 of the substrate cases 31 and 32, and are inserted into the connectors at the lower parts of the substrates 17 to 19. The substrates 17 to 19 are connected through the cables 33 to electrical components such as motors in the apparatus housing 110.

In the first embodiment, for maintenance of the maintenance target 102 on the back surface 101 of the apparatus housing 110, the screw 36 is removed, and the cables 33 are disconnected from the substrates 17 to 19. The cables 33 are pulled out of the substrate cases 31 and 32 to the outside of the substrate cases 31 and 32 through the opening portions 313 and 323. Then, the substrate cases 31 and 32 are caused to slidingly move to the right (see FIG. 4), so that the maintenance target 102 on the back surface 101 of the apparatus housing 110 is accessed.

The first embodiment is based on the assumption that the substrate cases 31 and 32 are allowed to slidingly move only to the right from a position at which the substrate cases 31 and 32 are fixed to the apparatus housing 110, and that the sliding movements of the substrate cases 31 and 32 to the left are prevented by the guide parts 41, 42 and a different mechanism. Meanwhile, the substrate cases 31 and 32 may also be allowed to slidingly move both to the right and left from the position at which the substrate cases 31 and 32 are fixed to the apparatus housing 110, or may slidingly move only to the left in a direction opposite the direction of sliding movements shown in FIG. 4.

The guide parts 41 and 42 guide the sliding movements of the substrate cases 31 and 32 to the right and left along the back surface 101 of the apparatus housing 110. The guide part 41 guides the upper parts of the substrate cases 31 and 32, and the guide part 42 guides the lower parts of the substrate cases 31 and 32.

The guide parts 41 and 42 support the substrate cases 31 and 32 on the apparatus housing 110 in a manner that allows the substrate cases 31 and 32 to move to the right and left between a first position and a second position in a direction parallel to the back surface 101 on which the maintenance target 102 is provided.

In the first embodiment, the first position is a position where the substrate cases 31 and 32 are fixed to the apparatus housing 110, and which makes the substrate cases 31 and 32 cover the maintenance target 102. In the first embodiment, the second position is a position that makes at least parts of the substrate cases 31 and 32 be separated farther from the apparatus housing 110 than the substrate cases 31 and 32 at the first position as shown in FIG. 4.

In other words, the first position is a position that makes the substrate cases 31 and 32 block access to the maintenance target 102 from outside the apparatus 1 during maintenance. The second position is a position that allows access to the maintenance target 102 from outside the apparatus 1 during maintenance.

In yet other words, the first position is a position contained in a first range extending in a direction to the right and left (a predetermined direction) parallel to the back surface 101 (side surface) of the apparatus housing 110 where the maintenance target 102 is provided closer thereto and covering also the position of at least part of the maintenance target 102.

Figure 6:
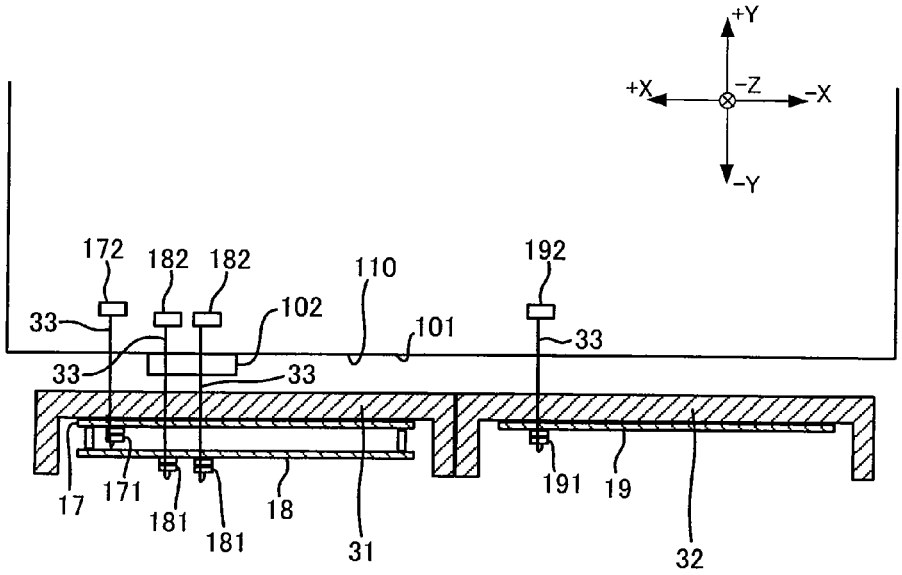
FIG. 6 is a diagram showing the positions of connectors of substrates and the positions of electrical components relative to each other.

FIG. 6 is a diagram showing the positional relationship between the positions of connectors 171, 181 and 191 of the substrates 17 to 19, and the positions of electrical components 172, 182 and 192 relative to each other.

The substrates 17 to 19 are arranged such that, when the substrate cases 31 and 32 are at the first position shown in FIG. 6, the connectors 171, 181 and 191 of the substrates 17 to 19 (in FIG. 6, only one connector is shown for each of the substrates 17 and 19) are placed at positions corresponding to the positions of the electrical components 172, 182 and 192 such as motors to which the connectors 171, 181 and 191 are to be connected. The correspondence mentioned here means positions that avoid bundling of the cables 33 due to tying, for example, and for example, these positions are such that the electrical components 172, 182 and 192, and the connectors 171, 181 and 191 are arranged in the +Y and −Y directions.

Accordingly, in the first embodiment, the cables 33 are separated from each other, making it possible to suppress the generation of noise in signals passing through the cables 33.

Figure 7:
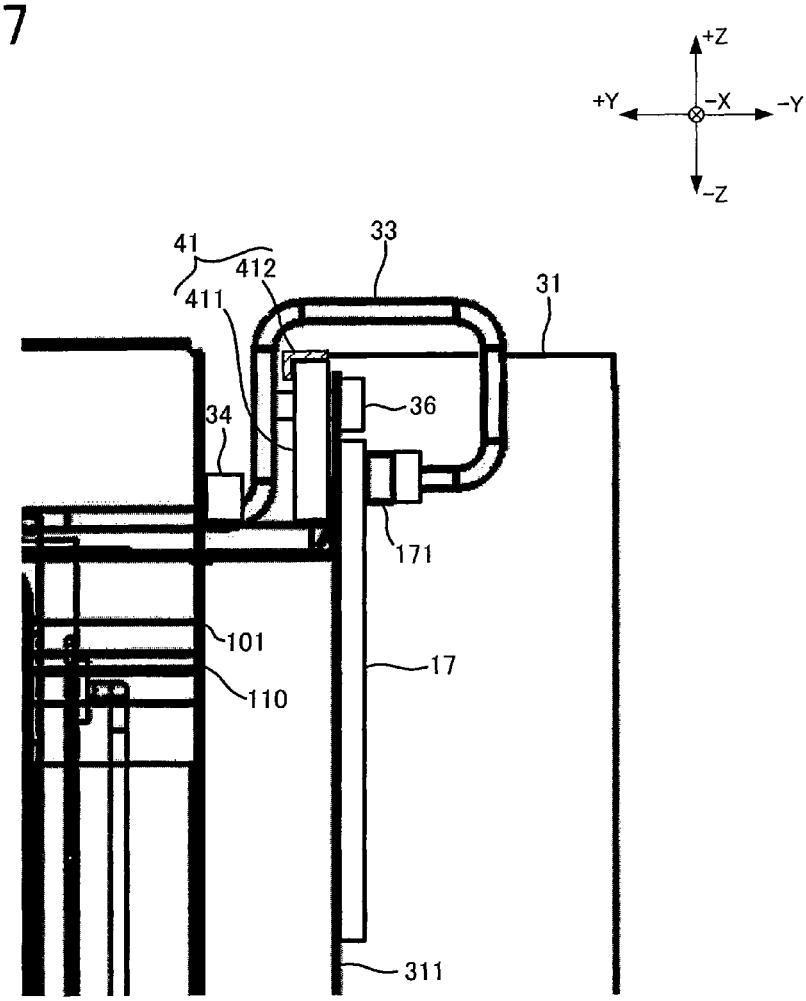
FIG. 7 is a diagram showing an upper guide part of a substrate case.

FIG. 7 is a diagram showing the upper guide part 41 of the substrate case 31. In order to facilitate understanding, only the IMG substrate 17 is shown on the substrate case 31 in FIG. 7. However, the substrates 17 and 18, and the HDD 20 are actually fixed on the substrate case 31. Further, the guide part 41 is also provided at the upper part of the substrate case 32.

The guide part 41 includes a rail section 411 provided to the apparatus housing 110, and a slider section 412 provided to the substrate cases 31 and 32. The rail section 411 is made of metal, and extends to the right and left along the back surface 101 of the apparatus housing 110. The slider section 412 is part of the substrate cases 31 and 32 made of metal, and is in the form of a hook. The slider section 412 is in engagement with the rail section 411, and slidingly moves on the rail section 411.

The screw 36 is screwed into the rail section 411 after passing through the substrate cases 31 and 32, thereby fixing the substrate cases 31 and 32 to the apparatus housing 110. The upper parts of the substrate cases 31 and 32 are electrically continuous with the apparatus housing 110 through the screw 36 and the guide part 41.

The regulating part 34 is attached to the apparatus housing 110. The regulating part 43 separates parts of the cables 33 from each other, and regulates movement of one cable 33 toward a different cable 33. Two or more regulating parts 34 are provided in a direction (+X and −X directions) perpendicular to the plane of FIG. 7. The positions of the regulating parts 34 are near the connectors 171, 181 and 191 of the substrates 17 to 19 in the +X and −X directions to which corresponding cables 33 are connected. The regulating parts 34 are required to cause the corresponding cables 33 to pass through positions separated from each other. The regulating parts 34 may fix parts of the cables 33 to the apparatus housing 110. Each of the regulating parts 34 may allow movement of a corresponding cable 33 in the direction of an axis thereof.

Figure 8:
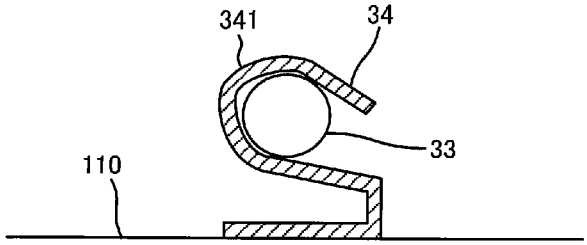
FIG. 8 is a diagram showing an example of a regulating part.
Figure 9:
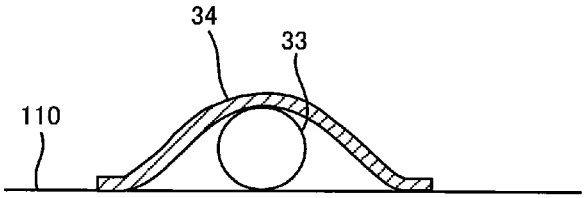
FIG. 9 is a diagram showing a different example of the regulating part.

FIG. 8 is a diagram showing an example of the regulating parts 34. In this example, the regulating parts 34 are each a resin clamping member with an elastically deformable U-shaped curved section 341. Placing the cables 33 in the curved sections 341 causes parts of the cables 33 to pass through positions separated from each other. In the present example, the cables 33 are each fixed to the regulating part 34 in the direction of the axis thereof. Meanwhile, each of the cables 33 may be clamped to the corresponding regulating part 34 in a manner that allows movement of the cable 33 in the direction of the axis thereof. FIG. 9 is a diagram showing a different example of the regulating parts 34. In this example, each of the regulating parts 34 is tape affixed to the apparatus housing 110 from above the cable 33 to fix part of the cable 33 to the apparatus housing 110.

As described above, in the first embodiment, the respective cables 33 routed from corresponding electrical components in the apparatus housing 110 toward the back surface 101 of the apparatus housing 110 are fixed in part to the apparatus housing 110 by the corresponding regulating parts 34 at positions separated from each other. This makes the cables 33 reach the substrates 17 to 19 by passing through the corresponding regulating parts 34 at positions separated from each other. Thus, the present embodiment is capable of reliably preventing the cables 33 from adjoining each other, thereby making it possible to satisfactorily suppress generation of noise in signals passing through the cables 33.

In the present embodiment, the regulating parts 34 fixing parts of the corresponding cables 33 to the apparatus housing 110 are at positions corresponding to the positions of the connectors 171, 181 and 191 of the substrates 17 to 19 to which the cables 33 are to be connected. Thus, even if the cables 33 are pulled out of the substrates 17 to 19 and the substrate cases 31 and 32 are caused to slidingly move for maintenance of the maintenance target 102 provided on the back surface 101 of the apparatus housing 110, the cables 33 are still at positions near the corresponding connectors 171, 181 and 191 of the substrates 17 to 19 even after the maintenance is finished and the substrate cases 31 and 32 return to their original positions. This makes it easy to connect the cables 33 to the corresponding connectors 171, 181 and 191 of the substrates 17 to 19, while suppressing generation of failure in connection.

Further, in the present embodiment, the connectors 171, 181 and 191 are provided on the substrates 17 to 19 such that, when the substrate cases 31 and 32 are at the first position at which the substrate cases 31 and 32 are fixed to the apparatus housing 110, the connectors 171, 181 and 191 are placed at positions corresponding to the positions of the electrical components 172, 182 and 192 to which the connectors 171, 181 and 191 are to be connected. Accordingly, even in the absence of the regulating parts 34, the cables 33 are still at positions near the corresponding connectors 171, 181 and 191 of the substrates 17 to 19 during maintenance of the maintenance target 102, allowing suppression of generation of connection failure.

Figure 10:
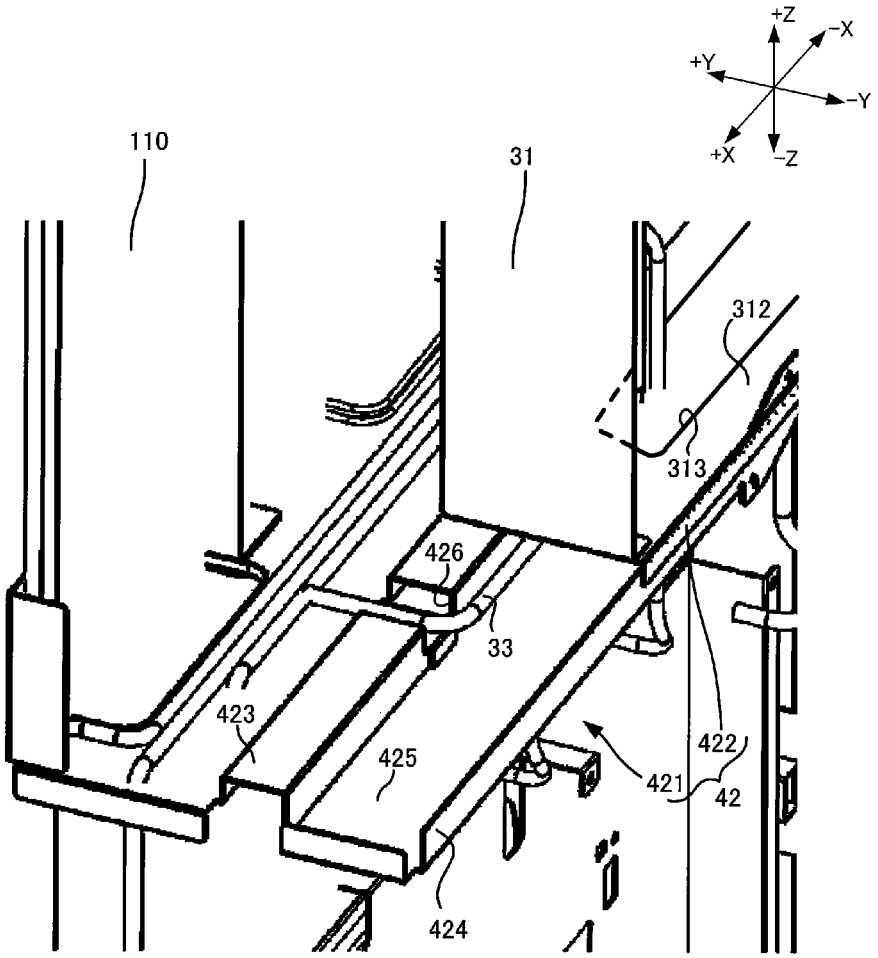
FIG. 10 is a diagram showing a guide part guiding lower part of the substrate case.

FIG. 10 is a diagram showing the guide part 42 guiding the lower part of the substrate case 31. The guide part 42 guiding the lower part of the substrate case 32 also has the structure of the guide part 42 shown in FIG. 10.

The guide part 42 includes a bottom surface supporting section 421 provided to the apparatus housing 110, and a side supporting section 422 provided to the substrate cases 31 and 32. The bottom surface supporting section 421 is made of metal. The bottom surface supporting section 421 includes a first bottom surface supporting part 423, a second bottom surface supporting part 424, and a recessed part 425.

The first bottom surface supporting part 423 extends in a direction (+X and −X directions) in which the substrate cases 31 and 32 are guided, and supports the lower parts of the substrate cases 31 and 32 on the side of the +Y direction near the apparatus housing 110. The first bottom surface supporting part 423 is in the form of a plane, and is placed nearer the apparatus housing 110 than the second bottom surface supporting part 424. The first bottom surface supporting part 423 is in contact with the bottom surface portions 312 and 322 in an area larger than the contact area of the second bottom surface supporting part 424 with the bottom surface portions 312 and 322. The first bottom surface supporting part 423 is in contact with the bottom surface portions 312 and 322, and is electrically continuous with the bottom surface portions 312 and 322.

The second bottom surface supporting part 424 is in the form of an upright plate, and extends in the direction (+X and −X directions) in which the substrate cases 31 and 32 are guided. The second bottom surface supporting part 424 supports the lower parts of the substrate cases 31 and 32 on the side of the −Y direction far from the apparatus housing 110.

The recessed part 425 is placed between the first and second bottom surface supporting parts 423 and 424. The cables 33 pass through the recessed part 425.

The side supporting section 422 of the substrate cases 31 and 32 is suspended from edge portions of the bottom surface portions 312 and 322 on a side (of the −Y direction) far from the apparatus housing 110. The side supporting section 422 is in contact with the outer surface of the second bottom surface supporting part 424, and is electrically continuous with the second bottom surface supporting part 424. The opening portions 313 and 323 of the substrate cases 31 and 32 are at positions that do not make the opening portions 313 and 323 overlap the first bottom surface supporting part 423 in the +Y and −Y directions when the side supporting section 422 is brought into contact with the outer surface of the second bottom surface supporting part 424.

The guide part 42 guides the lower parts of the substrate cases 31 and 32. The guide part 42 has an additional function of connecting the lower parts of the substrate cases 31 and 32 to the ground. In the present embodiment, a large contact area of the first bottom surface supporting part 423 with the bottom surface portions 312 and 322 allows the substrate cases 31 and 32 to be connected to the ground satisfactorily.

The first bottom surface supporting part 423 is given a notch 426 (regulating part). The notch 426 extends in the +Y and −Y directions perpendicular to the direction in which the substrate cases 31 and 32 are guided. Two or more notches 426 are formed in the first bottom surface supporting part 423, and are arranged in the +X and −X directions. Each of the notches 426 allows one cable 33 to pass therethrough. Each of the notches 426 may allow a plurality of cables 33 of a number that is capable of suppressing noise generation to pass therethrough. The cables 33 extending from the apparatus housing 110 are connected to the corresponding connectors 171, 181 and 191 of the substrates 17 to 19 after passing through the notches 426, the recessed part 425, and the opening portions 313 and 323 of the substrate cases 31 and 32.

The regulating parts 34 made of tape or the like not shown in the drawings fix parts of the cables 33 at appropriate positions separated from each other in the recessed part 425 and in the apparatus housing 110.

In the present embodiment, the notches 426 and regulating parts 34 not shown in the drawings also regulate movements of the cables 33 to be connected to connectors at the lower parts of the substrates 17 to 19 in a direction in which these cables 33 come closer to each other. Accordingly, unlike in a conventional example, the cables 33 are not bundled at one place. Thus, generation of noise in signals in the cables 33 to be connected to the connectors at the lower parts of the substrates 17 to 19 is also suppressed more effectively than the conventional example.

Further, the notches 426 and the regulating parts 34 not shown in the drawings regulate movements of the cables 33 to be connected to the 171, 181 and 191 of the substrates 17 to 19, and place the cables 33 at positions corresponding to the positions of the connectors 171, 181 and 191 to receive the corresponding cables 33. Accordingly, after maintenance is finished and the substrate cases 31 and 32 return to their original positions, the cables 33 to be connected to the lower parts of the substrates 17 to 19 are also at positions near the corresponding connectors 171, 181 and 191. Thus, in the present embodiment, regarding connections of the cables 33 to the lower parts of the substrates 17 to 19, the cables 33 are easily connected to the corresponding connectors 171, 181 and 191 of the substrates 17 to 19.

Second Embodiment

Figure 11:
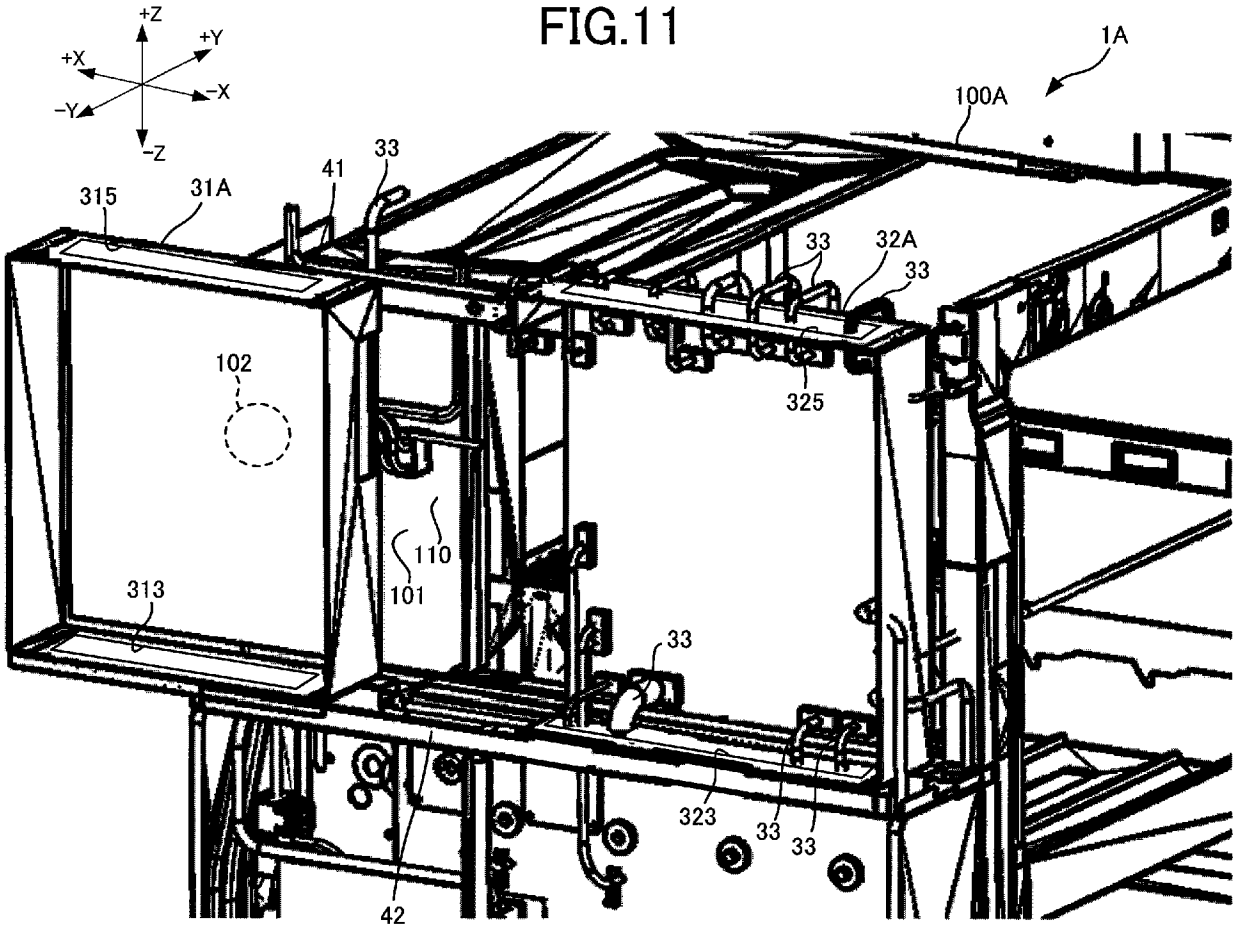
FIG. 11 is a perspective view of an apparatus body of a second embodiment as viewed from a back surface thereof.

FIG. 11 is a perspective view of an apparatus body 100A as viewed from a back surface 101 thereof.

The present embodiment is different from the first embodiment in that substrate cases 31A and 32A are formed as separate cases. The substrate cases 31A and 32A are each guided by guide parts 41 and 42, and are capable of slidingly moving to the right and left separately. Regulating parts 34 not shown in the drawings place parts of cables 33 at positions in an apparatus housing 110 separated from each other.

In an image forming apparatus 1A of the present embodiment, part placed inwardly of the right side of the back surface 101 (right side of FIG. 11) is an in-body sheet discharging place. Accordingly, on the back surface 101 of an image forming apparatus 1A, access is not made frequently through the right side of the back surface 101 of the apparatus housing 110. Meanwhile, a maintenance target 102 such as a motor is provided on the left side of the back surface 101 of the apparatus housing 110. Accordingly, the left side of the back surface 101 of the apparatus housing 110 is accessed frequently for maintenance of the maintenance target 102.

In a normal condition where the apparatus 1A, is in operation, the substrate cases 31A and 32A are aligned side by side and fixed with screws 36 to the apparatus housing 110. In this condition, the cables 33 are connected to corresponding connectors 171, 181 and 191 of substrates 17 to 19 respectively on the substrates 17 to 19.

When the maintenance target 102 on the left side of the back surface 101 of the apparatus housing 110 is maintained, the screw 36 for fixation of the substrate case 31A on the left is removed, and cables 33 connected to the substrates 17 and 18 are disconnected. Then, the substrate case 31A is caused to slidingly move to the left. This exposes the left side of the back surface 101 of the apparatus housing 110 to allow maintenance of the maintenance target 102. After the maintenance is finished, the substrate case 31A is caused to slidingly move to the right, and the substrate case 31A returns to its original position. Thereafter, the cables 33 are inserted into the corresponding connectors 171, 181 and 191 of the substrates 17 to 19. Then, the substrate case 31A is fixed with the screw 36 to the apparatus housing 110.

In the present embodiment, the regulating parts 34 also place the corresponding cables 33 at positions in the apparatus housing 110 separated from each other, making it possible to suppress generation of noise in signals passing through the cables 33. Further, when the cables 33 are disconnected from the substrates 17 to 19, the regulating parts 34 keep the corresponding cables 33 at positions that do not deviate largely from their original positions. This means that, when the substrate cases 31A and 32A return to their original positions, connectors of the cables 33 are placed at positions corresponding to the positions of the corresponding connectors 171, 181 and 191 of the substrates 17 to 19. Thus, the present embodiment also makes it easy to connect the connectors of the cables 33 to the corresponding connectors 171, 181 and 191 of the substrates 17 to 19, while suppressing generation of failure in connection of the cables 33 to the corresponding connectors 171, 181 and 191 of the substrates 17 to 19.

Each of the cables 33 may be one signal line. Each of the cables 33 may be a harness with signal lines that are bundled partway and are separated from each other at their tip end portions at which the cable 33 is connected to the substrate 17, 18 or 19. If the cables 33 are such harnesses, the regulating parts 34 each place part of a corresponding harness with bundled signal lines at the apparatus housing 110 by fixation, for example.

In each of the embodiments described above, the cables 33 are connected to the substrates 17 to 19 by passing through the top surface portions 314 and 324 and the bottom surface portions 312 and 322 of the substrate cases 31, 31A, 32 and 32A. Meanwhile, the cables 33 may be connected to the substrates 17 to 19 by getting over the top surface portions 314 and 324 and the bottom surface portions 312 and 322 of the substrate cases 31, 31A, 32 and 32A and without passing through the top surface portions 314 and 324 and the bottom surface portions 312 and 322.

In each of the embodiments described above, the guide parts 41 and 42 correspond to the case supporting part. However, the case supporting part is not limited to apart that supports the substrate cases 31, 31A, 32 and 32A in a manner that allows sliding movements of the substrate cases 31, 31A, 32 and 32A. For example, the case supporting part may be a part provided to either a right edge or a left edge of a substrate case, and which supports the substrate case in a manner that allows the substrate case to pivot relative to an apparatus housing. In this case, in order to access to a maintenance target on the back surface of the apparatus housing, the substrate case is caused to pivot about the case supporting part in a direction in which the substrate case is separated away from the back surface of the apparatus housing.

In each of the embodiments described above, the substrate cases 31, 31A, 32 and 32A move between the first position that makes the substrate cases 31, 31A, 32 and 32A cover the maintenance target 102, and the second position that makes the substrate cases 31, 31A, 32 and 32A be separated farther from the apparatus housing 110 than the substrate cases 31, 31A, 32 and 32A at the first position. However, a substrate case may alternatively move between a first position that makes a substrate case cover an associated member (such as a case covering a maintenance target) to be operated for access to the maintenance target, and a second position that makes the substrate case be separated farther from the associated member than the substrate case at the first position.

A recording medium of any type is applicable if it is capable of storing a program, and capable of being read by a computer. By way of example, the recording medium is an internal storage device placed inside a computer such as a ROM and a RAM, a portable storage medium such as a CD-ROM, a flexible disk, a DVD disk, a magneto-optical disk and an IC card, a database storing a computer program, a different computer, or a database of the different computer. A function obtained by installation or downloading may be put into use in cooperation with an OS and the like in the apparatus. A program may be an executable module part or all of which is generated dynamically.

As described in detail above, the technique described herein is capable of providing a technique of routing a cable in an image forming apparatus.

While certain embodiments have been described, these embodiments have been presented by way of example only, and are not intended to limit the scope of invention. Indeed, the novel apparatus, methods and system described herein may be embodied in a variety of other forms; furthermore, various omissions, substitutions and changes in the form of the apparatus, methods and system described herein may be made without departing from the spirit of the inventions. The accompanying claims and their equivalents are intended to cover such forms or modifications as would fall within the scope and spirit of the inventions.

What is claimed is:

1. An image forming apparatus, comprising:

a maintenance target being a target of maintenance;

an apparatus housing that houses the maintenance target;

a substrate case that holds a control substrate that is electrically connectable at a plurality of connections to a plurality of electrical components provided in the apparatus housing when the substrate case is in a first position;

a plurality of cables that extend from the apparatus housing for connecting the electrical components to the connections at an exterior side of the substrate case that is opposite a side of the substrate case facing the apparatus housing;

a plurality of regulating parts attached to the apparatus housing, the regulating parts configured to hold each of the plurality of cables separate from each other and to prevent movement of each the cables relative to the other cables; and a case supporting part that supports the substrate case on the apparatus housing in a manner that allows the substrate case to slide linearly and horizontally between the first position and a second position, wherein in the first position, the substrate case blocks access to the maintenance target from outside the apparatus, and in the second position, the substrate case allows access to the maintenance target from outside the apparatus for maintenance, and the control substrate is positioned on the substrate case so that, when the substrate case is in the first position, the connections are placed at positions corresponding to the cables as positioned by the regulating parts by which the control substrate is to be connected to the electrical components.

2. The apparatus according to claim 1, wherein the substrate case has a bottom surface portion, and the case supporting part has a bottom surface supporting section extending in a direction in which the substrate case is guided and supporting the bottom surface portion, the bottom surface supporting section being in contact with the bottom surface portion and being electrically continuous with the bottom surface portion when the case supporting part guides the substrate case.

3. The apparatus according to claim 1, wherein the regulating parts are positioned above the substrate case, and the cables hang down from the regulating parts when the cables are connected to the connections.

4. An image forming apparatus, comprising:

a maintenance target being a target of maintenance;

an apparatus housing that houses the maintenance target;

a substrate case that holds a control substrate that is electrically connectable at a plurality of connections to a plurality of electrical components provided in the apparatus housing when the substrate case is in a first position;

a plurality of cables that extend from the apparatus housing for connecting the electrical components to the connections at an exterior side of the substrate case that is opposite a side of the substrate case facing the apparatus housing;

a plurality of regulating parts attached to the apparatus housing, the regulating parts being configured to hold each of the plurality of cables separate from each other and to prevent movement of each the cables relative to the other cables; and a case supporting part that supports the substrate case on the apparatus housing in a manner that allows the substrate case to slide linearly and horizontally between the first position and a second position, wherein in the first position, the substrate case covers the maintenance target or an associated member that is operated for access to the maintenance target, and in the second position, the substrate case is separated from the apparatus housing at a distance greater than when the substrate case is in the first position, and the control substrate is positioned on the substrate case so that, when the substrate case is in the first position, the connections are placed at positions corresponding to the cables as positioned by the regulating parts by which the control substrate is to be connected to the electrical components.

5. The apparatus according to claim 4, wherein the substrate case has a bottom surface portion, and the case supporting part has a bottom surface supporting section extending in a direction in which the substrate case is guided and supporting the bottom surface portion, the bottom surface supporting section being in contact with the bottom surface portion and being electrically continuous with the bottom surface portion when the case supporting part guides the substrate case.

6. The apparatus according to claim 4, wherein the regulating parts are positioned above the substrate case, and the cables hang down from the regulating parts when the cables are connected to the connections.

* * * * *